US009717342B2

(12) United States Patent
Bates

(10) Patent No.: US 9,717,342 B2
(45) Date of Patent: Aug. 1, 2017

(54) DEVICE AND METHOD FOR ASSISTING PATIENTS AFTER A BUTTOCKS SURGERY

(71) Applicant: Tanya Bates, Swindon (GB)

(72) Inventor: Tanya Bates, Swindon (GB)

( * ) Notice: Subject to any disclaimer, the term of this patent is extended or adjusted under 35 U.S.C. 154(b) by 101 days.

(21) Appl. No.: 14/918,367

(22) Filed: Oct. 20, 2015

(65) Prior Publication Data

US 2016/0106217 A1 Apr. 21, 2016

Related U.S. Application Data

(60) Provisional application No. 62/066,516, filed on Oct. 21, 2014.

(51) Int. Cl.
*A47C 7/02* (2006.01)
*A47C 7/42* (2006.01)

(52) U.S. Cl.
CPC ..... *A47C 7/021* (2013.01); *A47C 7/022* (2013.01); *A47C 7/425* (2013.01)

(58) Field of Classification Search
None
See application file for complete search history.

(56) References Cited

U.S. PATENT DOCUMENTS 4,643,481 A * 2/1987 Saloff ..... A61G 5/1043 297/452.25
4,712,833 A * 12/1987 Swanson ..... A47D 1/004 297/219.12
4,889,387 A * 12/1989 Gregory ..... A47C 7/022 297/452.27
5,018,790 A * 5/1991 Jay ..... A47C 7/021 297/284.1
5,294,181 A * 3/1994 Rose ..... A47C 7/021 297/452.25
5,343,876 A * 9/1994 Rogers ..... A47C 7/022 128/845
5,390,384 A * 2/1995 Dinsmoor, III ..... A47C 7/021 297/452.27
5,402,545 A * 4/1995 Jolley ..... A47C 7/022 297/467
5,407,247 A * 4/1995 Forcier ..... A47C 7/021 297/229
5,452,940 A * 9/1995 Maier ..... A47C 7/022 297/452.27
5,899,529 A * 5/1999 Chaucer ..... B60N 2/2821 224/275

(Continued)

FOREIGN PATENT DOCUMENTS

AU GB 2334208 A * 8/1999 ..... A47C 4/52
CA 2108685 C * 11/2000 ..... A47C 4/54

(Continued)

*Primary Examiner* — David E Allred

(57) ABSTRACT

A device configured to relieve pressure caused by the full weight of a patient on the buttocks area of the patient when in a sitting position, by instead placing and averting the pressure on the thighs. The device may be efficacious for use after a buttock augmentation surgery including, but not limited to, Butt Implants, Brazilian Butt Lift, Fat Transfer, Fat Grafting, Butt Shots, Liposuction & any other procedure affecting the lower rear area of a human trunk. These procedures prevents a patient from sitting directly on the buttocks.

20 Claims, 6 Drawing Sheets

(56) References Cited

U.S. PATENT DOCUMENTS

| | | | | |
|---|---|---|---|---|
| 6,202,234 | B1 * | 3/2001 | Henderson | A47C 7/021 297/452.26 |
| 6,457,773 | B1 * | 10/2002 | Gates | A47C 7/021 297/219.1 |
| 6,581,227 | B1 * | 6/2003 | Obermaier | A47C 7/022 5/653 |
| 6,901,617 | B2 * | 6/2005 | Sprouse, II | A47C 4/54 297/219.1 |
| 6,929,325 | B1 * | 8/2005 | Goelo | A47C 1/16 297/183.5 |
| 7,024,712 | B2 * | 4/2006 | Fujita | A47C 7/022 297/202 |
| 7,373,678 | B2 * | 5/2008 | Hetzel | A47C 7/022 29/91.1 |
| 9,220,345 | B2 * | 12/2015 | Davis | A47C 7/62 |
| 9,427,366 | B2 * | 8/2016 | Melcher | A61G 7/075 |
| 2014/0252825 | A1 * | 9/2014 | Amirault | B60N 2/2866 297/250.1 |
| 2016/0120319 | A1 * | 5/2016 | Davis | A47C 7/62 5/648 |
| 2016/0174717 | A1 * | 6/2016 | Mitchell | A47C 7/022 297/183.5 |

FOREIGN PATENT DOCUMENTS

| | | | | |
|---|---|---|---|---|
| CA | 2531747 C | * | 12/2011 | A47C 7/022 |
| JP | WO 2015012321 A1 | * | 1/2015 | A47C 31/11 |

* cited by examiner

DEVICE AND METHOD FOR ASSISTING PATIENTS AFTER A BUTTOCKS SURGERY

CROSS-REFERENCE TO RELATED APPLICATIONS

The present Utility patent application claims priority benefit of the U.S. provisional application for patent Ser. No. 62/066,516 filed 21 Oct. 2014 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD OF THE INVENTION

One or more embodiments of the invention generally relate to a supportive device. More particularly, the invention relates to a supportive device that provides an inclined seat portion that supports and elevates the thighs above a seating surface, such that the buttocks are restricted from engaging the seating surface, and further including a back portion that helps support the back when a user is sitting on the seat portion.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that butt augmentation surgery denotes the plastic surgery and the liposculpture procedures for the correction of the congenital, traumatic, and acquired defects and deformities of the buttocks and the anatomy of the gluteal region; and for the aesthetic enhancement of the contour of the buttocks.

It is believed that after a butt augmentation, a patient must relieve pressure on the buttocks to enable proper healing. The patient must minimize sitting and pressing on the buttocks. Often, the patient must sit on the back and buttocks region for sleeping, eating, and resting.

Generally, a chair support pillow is used to aid patients sitting on a chair without putting any pressure on the buttock area.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
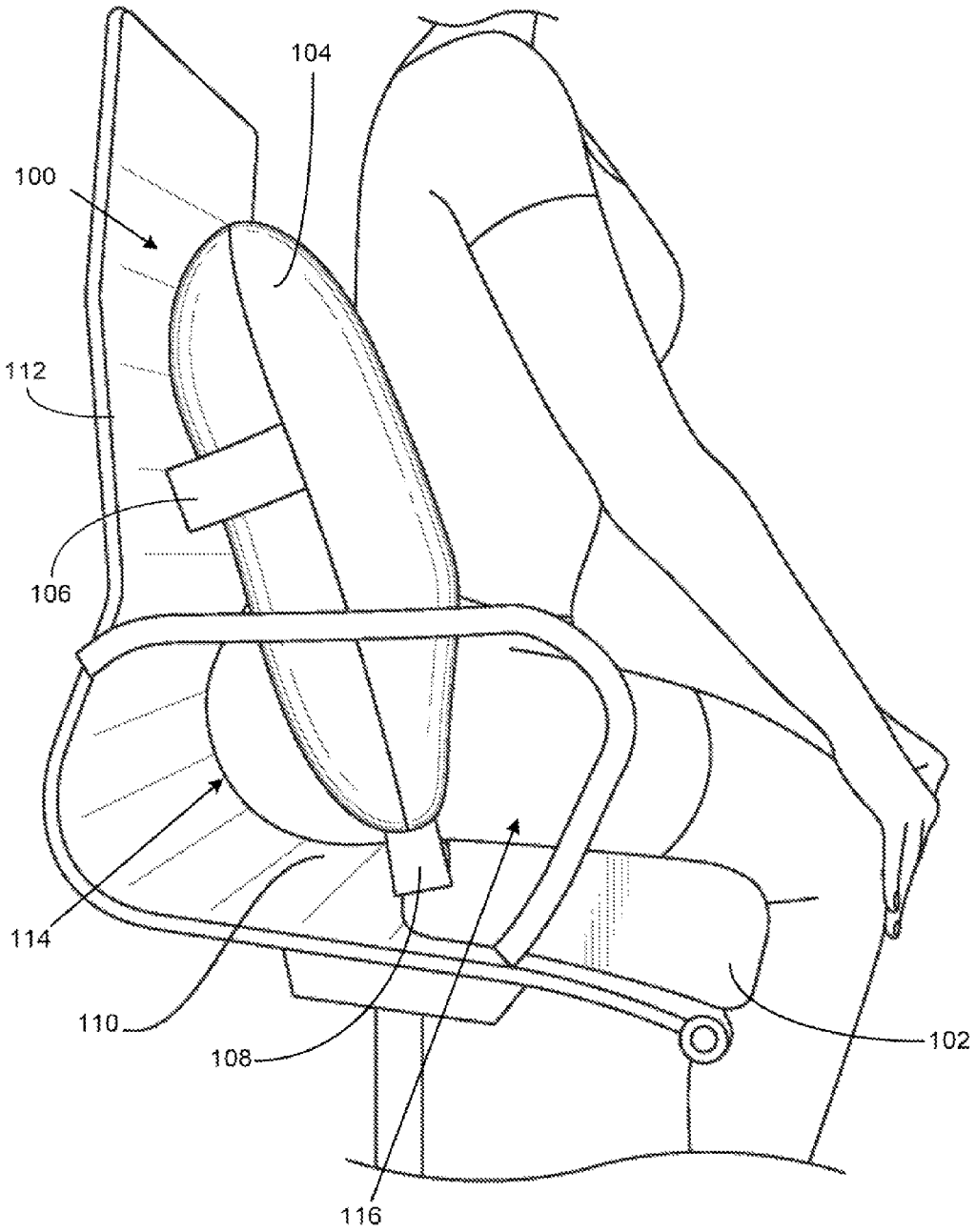
FIG. 1 illustrates a perspective view of an exemplary supportive device supporting a buttocks above an exemplary seating surface, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. §112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

There are various types of supportive pillows that reduce pressure on the buttocks that may be provided by preferred embodiments of the present invention. In one embodiment of the present invention, a supportive device helps relieve pressure on the buttocks when in a sitting position by instead placing pressure on the thighs. The supportive device may be efficacious for use after a buttock augmentation surgery including, but not limited to, Butt Implants, Brazilian Butt Lift, Fat Transfer, Fat Grafting, Butt Shots, Liposuction & any other procedure which prevents a patient from sitting directly on the buttocks. The supportive device may aid a patient sitting on a chair without putting any pressure on the buttocks area after a Buttock Augmentation Surgery including.

In some embodiments, the supportive device may provide a seat portion that supports and elevates the thighs above a surface of a chair seating section, elevating the buttocks area, such that the buttocks are restricted from engaging the surface, which may cause pain and discomfort to a patient that underwent a surgery. The seat portion may be defined by a generally lightweight, rectangular prism configured to comfortably support the thighs. The seat portion may have a gradient that elevates the buttocks above the thighs and knees, such that the buttocks hang over the edge of the seat portion. The seat portion may be bifurcated into a lower region having rigid support for solid support on a seating surface, and an upper region having being more resilient for enhanced comfort in the sitting position.

The supportive device may further include a back portion that detachably attaches to the seat portion and helps to support the back. The seat portion helps relieves pressure on the buttocks by instead placing pressure on the thigh area when a user is in a sitting position. The back portion also provides a cushioned support for the back of the patient while in the sitting position, providing further relief to the back of the patient.

In some embodiments, the supportive device is configured to operate on a seating surface having an upright back section. The seat portion may be configured to rest on the seating surface and provides support along the front of the thighs. The back portion may pivot in relation to the seat portion, so as to engage the back section of the seating surface.

In some embodiments, the seat portion may comprise an upper region that supports the thighs, and a lower region that engages a seat. The lower region may be fabricated from a firm material, such as recycled foam. The upper region may be fabricated from a resilient material, such as memory foam. A pair of depressions traversing the seat portion may help cradle the thighs.

The seat portion may also include a front wall oriented to face forward towards the knees of a sitting user. The front wall provides a surface for the knees to hang from. The seat portion may also have a rear wall oriented to face rearward towards the back section of the seating surface. The rear wall terminates at the rear of the thighs, but does not engage the buttocks. The seat portion is operable towards the front of the seating surface, such that a space forms between the rear wall and the back section of the seating surface.

In some embodiments, a height of the front wall is smaller than the height of back wall. This height difference creates an incline in the upper region. Thus, the seat portion may have a gradient that slopes from the rear wall down to the front wall. In this manner, the buttocks are elevated above the front thighs and knees when the patient is in a sitting position. In some embodiments, the seat portion may include at least one seat fastener. The seat portion may also include an outer cover for protecting and carrying the seat portion.

In some embodiments, a back portion is configured to provide support to the back of the patient while the patient is sitting on the seat portion. The back portion may be disposed generally perpendicular to the seat portion, and coplanar to a back section of the surface. The back portion may be U-shaped with a supportive perimeter and a medial space that enables the back of the patient to nestle inside the back portion. The back portion may include at least one back fastener for detachably fastening to the seat fastener. In this manner, the back portion can fold into the seat portion for storage and portability. The back portion may also be detached from the seat portion, such that the seat portion or the back portion are used independently of each other.

FIG. 1 illustrates a perspective view of an exemplary supportive device supporting a buttocks above an exemplary seating surface, in accordance with an embodiment of the present invention. In one aspect, a supportive device 100 may provide a seat portion 102 that supports and elevates the thighs 116 above a seating surface 110. In this manner, the buttocks 114 of the user are restricted from engaging the seating surface. The seat portion may be defined by a generally lightweight, rectangular prism configured to comfortably support the thighs. The seat portion may have a gradient that elevates the buttocks above the thighs and knees, such that the buttocks hang over the edge of the seat portion. The seat portion may be bifurcated into a lower region having rigid support for solid support on a seating surface, and an upper region having being more resilient for enhanced comfort in the sitting position. The lower region may be horizontally cut at an angle to provide a horizontally sloping seat portion toward the knees of a sitting patient. The horizontally sloping seat portion may help the patient disembark the seat portion, from a sitting position to a standing position with lesser effort.

The supportive device further includes a back portion 104 that is detachable from the seat portion. The back portion provides a comfortable, adjustable support for the back and can rest against an upright back section 112 of the seating surface. The back portion may create a synergy with the seat portion by supporting the back while the user is in the partially elevated, sitting position. Possible shapes for the seat portion could be a Oval shape, Arch shape, Crescent shape, Square shape, Lens shape, Kidney shape, Trapezoid shape, Pentagon shape, Nephroid shape. The back portion could be Crescent shape, Square shape, Arch shape, Nephroid shape, Dome shape, Toroid shape, and Square shape.

Those skilled in the art will recognize that buttock augmentation surgery, including but not limited to; implants, fat transfer, fat grafting, Brazilian butt lift, butt shots, Fat Transfer, Fat Grafting, Butt Shots, liposuction, and any other surgery affecting the lower rear area of a human trunk, demand that the user does not sit on, or apply pressure to the buttocks, which may cause pain and discomfort. After these kinds of surgery, patients cannot sit or put pressure on their buttocks for a duration, so that the buttocks can heal properly. The supportive device is configured to position on a seating surface, such as a chair, to elevate the buttocks and also to provide support for the back. The supportive device is lightweight, portable and operable on any flat seating surface, such as a chair, a sofa, and a vehicle seat.

The back portion detachably attaches to the seat portion and helps to support the back. The supportive device helps relieves pressure on the buttocks by instead placing pressure on the thigh area when a user is in a sitting position. The seat portion and the back portion detachably join to create a synergy that helps alleviate pressure on the buttocks while in a sitting position. At least one seat fastener 106 and at least one back fastener 108 fasten the seat portion to the back portion. The fasteners may include, without limitation, hook and loop fasteners, buttons, Velcro, magnets, and adhesives.

In some embodiments, the supportive device is configured to operate on a seating surface 110 having an upright back section. The seat portion may be configured to rest on the seating surface and provides support along the front of the thighs. The back portion may pivot in relation to the seat portion, so as to engage the back section of the seating surface.

In other embodiments, the supportive device may provide support to a patient being led on the back with a stretcher. The patient's thigh portion may be placed at the seat portion facing forward to elevate the buttocks area from the floor or a surface of the stretcher. The back portion may be used to support the head and shoulders of the patient whilst the patient is being led horizontally.

Figure 2:
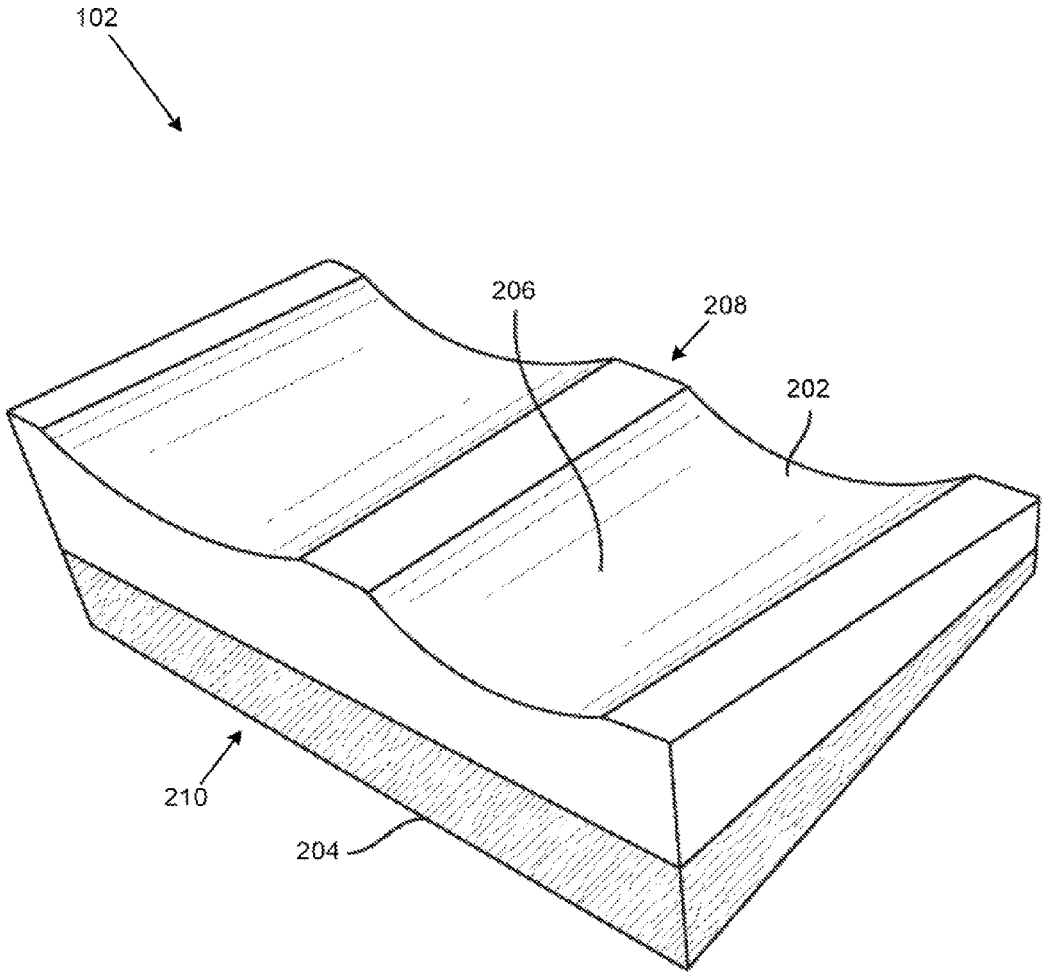
FIG. 2 illustrates a perspective view of an exemplary seat portion, comprised of an exemplary upper region and lower region, in accordance with an embodiment of the present invention.

FIG. 2 illustrates a perspective view of an exemplary seat portion, comprised of an exemplary upper region and lower region, in accordance with an embodiment of the present invention. In one aspect, the seat portion may comprise an upper region 202 that supports the thighs and buttocks area, ensuring the buttocks area of a patient is elevated and not touching the base of a seat or chair implement where the seat portion is employed. The seat portion may further comprise of a lower region 204 that engages a surface of a seating section of the seat or chair implement. The lower region may be fabricated from a firm material, such as recycled or re-bond foam. The lower region may be horizontally cut at an angle to provide a horizontally sloping seat portion toward the knees of a sitting patient. The horizontally sloping seat portion may avert a full weight of the patient being exerted on the buttocks area to the thigh area, while on a sitting position. The horizontally sloping seat portion may also help the patient disembark the seat portion, from a sitting position to a standing position with lesser effort. The upper region may be fabricated from a resilient material, such as memory foam. The upper region and the lower region may be joined with a flexible and resilient adhesive or fixative including, but not limited to glue, epoxy, epoxy cement, rubber, plastic, etc, to form a unitary, single, or uniform entity. In an alternative, the upper region and the lower region may be joined by, but not limited to, sewing, stitching, weaving, embroidery, needlework, needlecraft or tapestry. A pair of depressions 206, such as thigh grooves, traverse the upper region of the seat portion. The depressions may have an outline or surface that curves inward like the shape of a patient buttocks area. The depressions may help cradle the thighs while in the sitting position and maximize the use of the whole seating surface area. The depressions may help relieve pressure on the buttocks area caused by the full weight of the patient in a sitting position, by distributing the full weight of the patient on a wider seating surface area and may avoid focusing the full weight of the patient on the buttocks area. The pair of depressions may be aligned with the horizontal sloping of the seat portion. The depressions may have an outline or surface that curves inward like the interior of, but not limited to, a circle, a sphere, an oval, or a tube. Though in other embodiments, the depressions are not limited to the upper region of the seat portion, but may also be constructed in the lower region. A bottom surface of the lower region may comprise of a third depression that conforms to the surface of a chair where the seat portion is used. The third depression at the bottom of the lower region may help stabilize the seat portion where it is used. The seat portion may be configured to conform to the size of a small chair, medium sized chair, or a large sized chair. The chair may comprise of, but no limited to, a seat, a pew, a bench, a couch, a lounge, a settee, a stool, a recliner, a bed, a sofa, or any other resting implement. The depressions may be configured to conform to the size of a small patient, a medium sized patient, or a large sized patient. In other embodiments, the lower and upper regions may also be fabricated from, but not limited to, EVA Foam, Memory foam, Polyurethane Foam, Closed Cell Foam, Rubber, Inflatable PVC or textile reinforced Urethane Plastic, or Inflatable Nylon, Rebond Foam, Recycled Foam, Polystyrene, Polyethylene, Polypropylene, PU Foam, or a combination of a foam and inflatable material above. In some embodiments, the seat portion is a single piece comprising the pair of depressions and horizontally sloping gradient. The seat portion may be washable to remove dirt, stains, soil, and/or smear. The seat portion may be sanitized to prevent disease causing bacteria or viruses from infecting the patient.

The seat portion may also include a front wall component 208 oriented to face forward towards the knees of a sitting user. The front wall component provides a surface for the knees to hang from. The seat portion may also have a rear/back wall component 210 oriented to face rearward towards the back section of the seating surface. The rear/back wall component terminates at the rear of the thighs, but does not engage the buttocks. The seat portion is operable towards the front of the seating surface, such that a space forms between the rear wall and the back section of the seating surface.

In some embodiments, a height of the front wall is smaller than the height of the rear/back wall. This height difference creates an incline in the upper region. Thus, the seat portion may have a gradient that horizontally slopes from the rear wall down to the front wall. In this manner, the buttocks are elevated above the front thighs and knees when the user is in a sitting position. And, the horizontally sloping seat portion may help the patient disembark the seat portion, from a sitting position to a standing position with lesser effort. In some embodiments, the seat portion may include at least one seat fastener. The seat portion may also include a washable and reusable outer cover for protecting and carrying the seat portion.

In some embodiments, a back portion is configured to provide support to the back of the user while the user is sitting on the seat portion. The back portion may be disposed generally perpendicular to the seat portion, and coplanar to a back section of the surface. The back portion may be U-shaped with a supportive perimeter and a medial space that enables the back of the user to nestle inside the back portion. The back portion may include at least one back fastener for detachably fastening to the seat fastener. In this manner, the back portion can fold into the seat portion for storage and portability. The back portion may also be detached from the seat portion, such that the seat portion or the back portion are used independently of each other.

Figure 3:
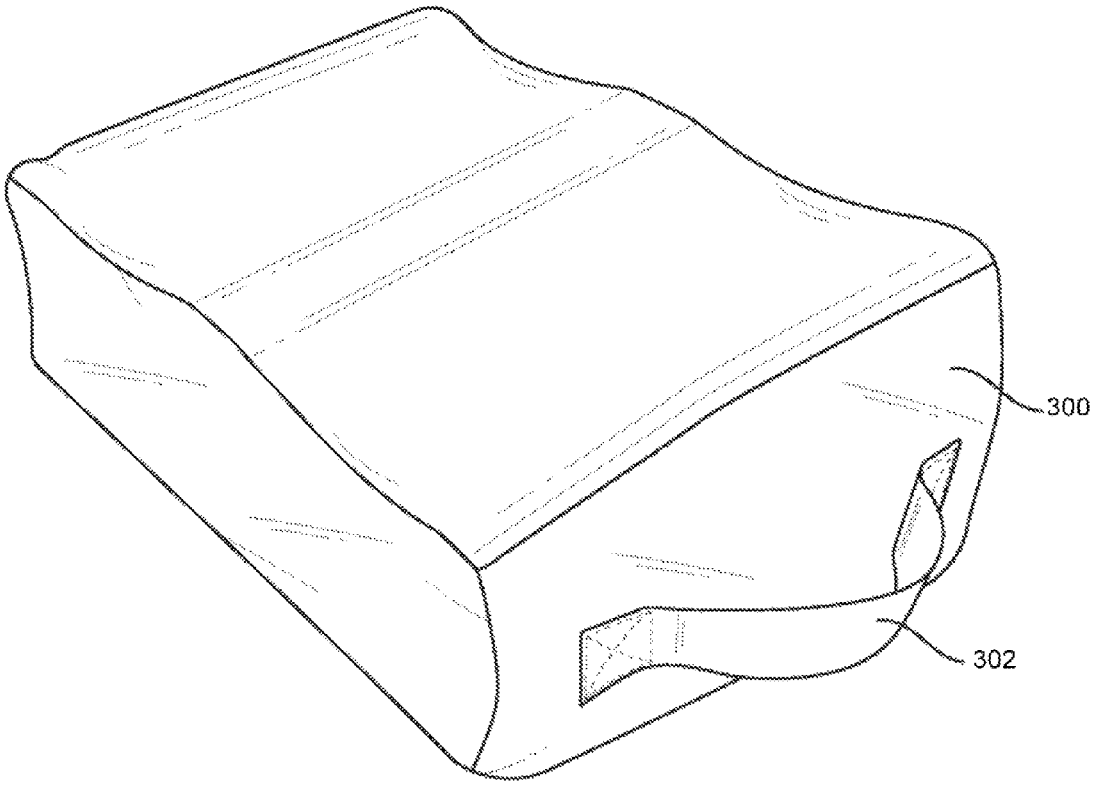
FIG. 3 illustrates a perspective view of a seat portion covered in an exemplary outer cover, in accordance with an embodiment of the present invention.

FIG. 3 illustrates a perspective view of a seat portion covered in an exemplary outer cover implement, in accordance with an embodiment of the present invention. In one aspect, the seat portion and/or the back portion may be compressed and covered for storage and portability. An outer cover implement 300 patterned in a general shape of the seat portion may be configured to receive the seat portion. The outer cover implement may be configured to correspond to the pair of depressions 206. The outer cover implement may be further configured to conform to the horizontal sloping of the seat portion. The outer cover implement may have fastening means to secure the seat portion inside. In one embodiment, the seat portion outer cover implement includes a handle instrument 302 to aid in carrying the seat portion when moving the seat portion to another location. The handle instrument may extend through a registering aperture in the outer cover implement. The outer cover implement may be fabricated from cotton, leather, woven or knitted materials, which the woven or knitted material are made from, but not limited to, natural, cellulose, or synthetic fibers. The outer cover implement may include signs, logos, advertisements. The outer cover implement may be removable and washable to remove dirt, stains, soil, and/or smear. The outer cover implement may be sanitized to prevent disease causing bacteria or viruses from infecting the patient. The outer cover implement may be reusable.

In some embodiments, the outer cover may be fabricated from polar fleece, cotton, velour, and microfiber material. The outer cover may be colored or white, and patterns may be used. The outer cover may also include a non-slip bottom. However the outer cover is not limited to having an unzippable cover or a non-slip bottom. In one alternative embodiment, the seat portion may also utilize an inner cover to protect the contents when washing the outer cover.

Figure 4:
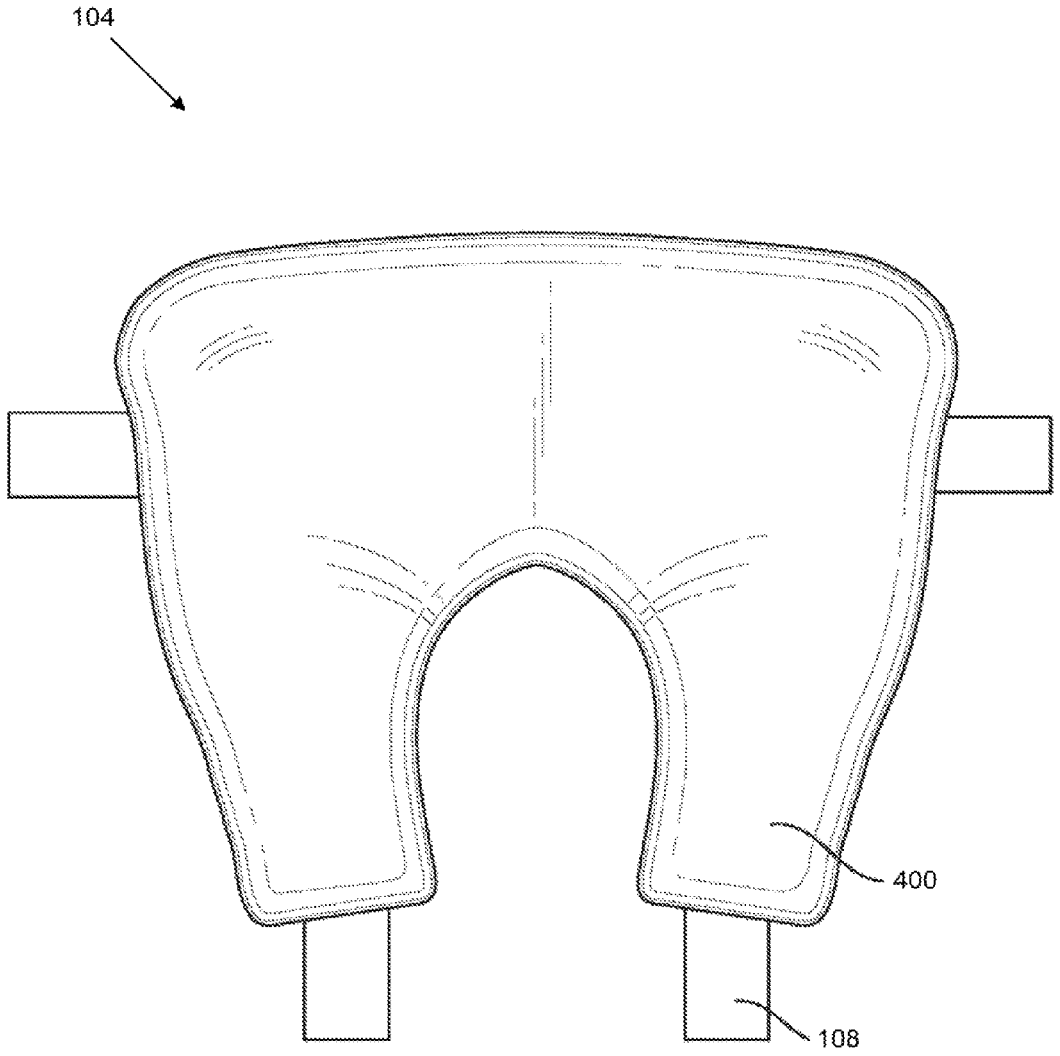
FIG. 4 illustrates a perspective view of an exemplary back portion, in accordance with an embodiment of the present invention.

FIG. 4 illustrates a perspective view of an exemplary back portion, in accordance with an embodiment of the present invention. In one aspect, the back portion is configured to provide a comfortable support to the back while the seat portion offers the chief function of elevating the buttocks. The back portion is loosely and detachably joined with the seat portion in a manner that allows the back portion to pivot in relation to the seat portion. This configuration allows the seat portion to be positioned towards the front edge of the seating surface, while the back portion fully engages the back section of the seating surface. The back portion may have a cushion surface 400 that serves, substantially as a pillow.

Figure 5:
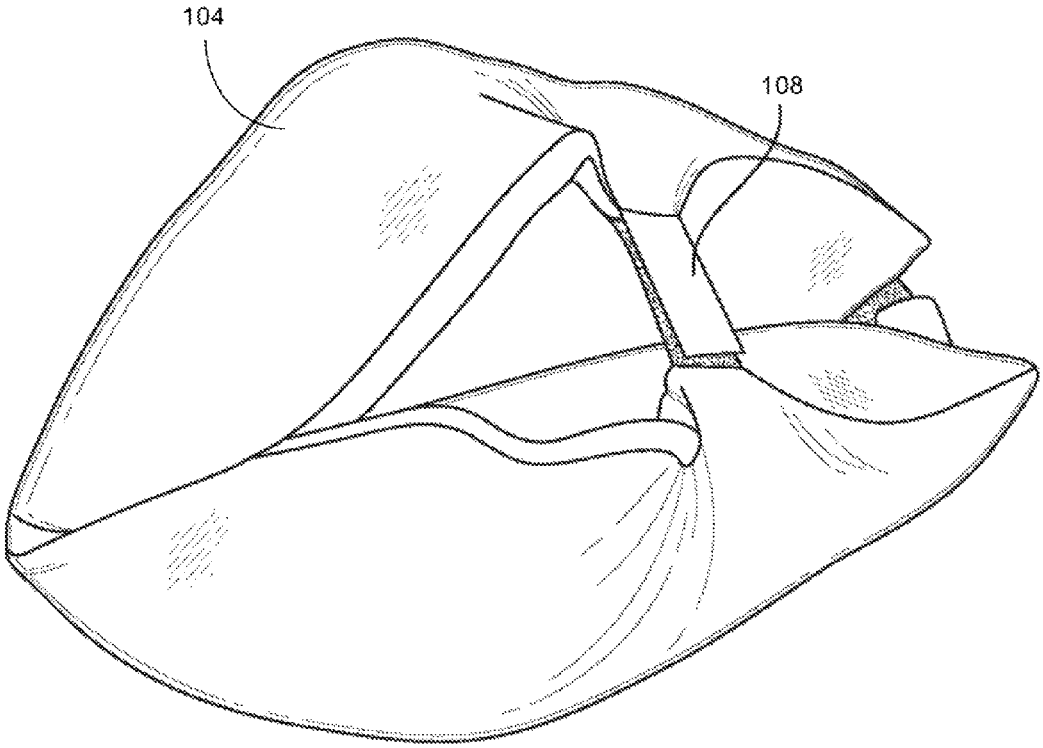
FIG. 5 illustrates a perspective view of a back portion folded in half for storage, in accordance with an embodiment of the present invention.

FIG. 5 illustrates a perspective view of a back portion folded in half for storage, in accordance with an embodiment of the present invention. In one aspect, the generally cushioned, resilient fabrication of the back portion enables the back portion to fold into itself for storage and portability. In one embodiment, multiple back fasteners positioned around the perimeter of the back portion fasten together to retain the back portion in the folded configuration. Similarly, the back portion may fold into the seat portion and the back fasteners and seat fasteners serve to retain the folded configuration.

Figure 6:
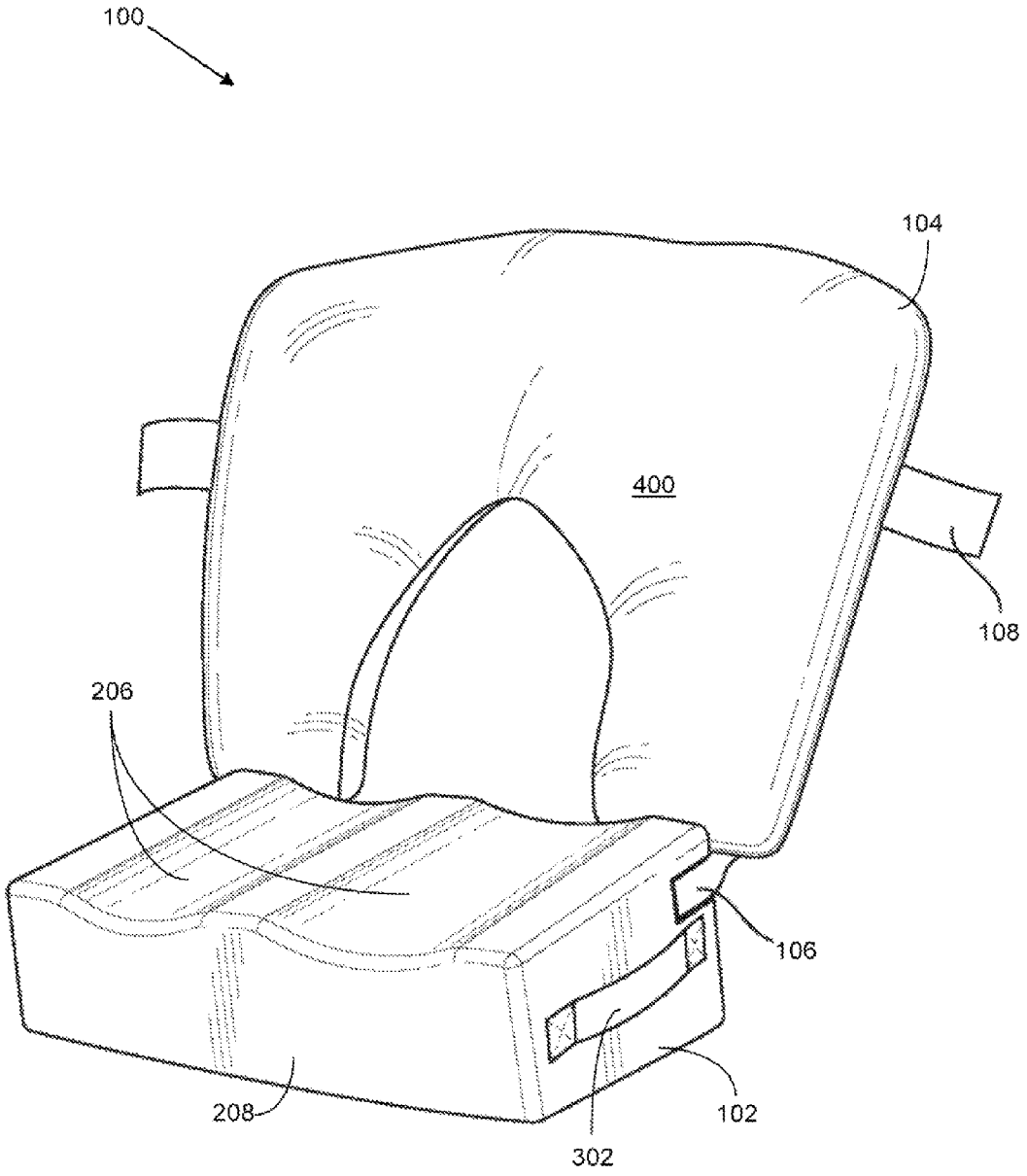
FIG. 6 illustrates a perspective view of a supportive device comprised of a seat portion attached to a back portion, in accordance with an embodiment of the present invention.

FIG. 6 illustrates a perspective view of a supportive device comprised of a seat portion attached to a back portion, in accordance with an embodiment of the present invention. In one exemplary use of the supportive device, an elongated seat portion forms a pillow that includes a lower region and an upper region. The lower region of the pillow is flat to allow use of the pillow on a surface such as a chair, sofa, or any location that requires the user to sit. The upper region of the pillow is slightly sloped towards the front wall. The front wall of the pillow is positioned at a slightly lower elevation than the rear wall of the pillow.

In operation, the pillow is positioned under the surgery patient's thighs and extends the buttocks area from the rear wall of the pillow. As a result, the surgery patent's buttocks area remain elevated above the seating surface. This provides sufficient support for the user's buttocks without exerting any pressure on the buttocks region as all pressure from the pillow is directed to the thighs. In other operations, the supportive device may provide support to a patient being led on the back with a stretcher. The patient's thigh portion may be placed at the seat portion facing forward to elevate the patient's buttocks area from the surface of the stretcher. The back portion may be used to support the head and shoulders of the patient whilst the patient is being led horizontally.

In one embodiment, the sloped upper region of the support pillow positions the user's legs in a forward and downward position for comfort while seated. This provides stability for the user's body with the buttocks extending from the rear portion of the support pillow. The pillow may be uniformly composed of hard foam that provides comfort without causing the user to sink while sitting on the pillow. This allows a buttock augmentation surgery patient to sit in a relatively normal position for extended periods of time in the aftermath of the surgical procedure in a state of physical ease and freedom from pain or constraint caused by the procedure.

In an alternative embodiment, the seat and back portion is filled with, but not limited to, air, gel, liquid, soft material, or a combination of air and soft material. In another alternative embodiment, the back portion has motorized balls that massage the back. In yet another alternative embodiment, the gradient between the front wall and the rear wall is adjustable to conform to the various seating surfaces.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing a supportive device that supports and elevates the buttocks above a seating surface according to the present invention will be apparent to those skilled in the art. Various aspects of the invention have been described above by way of illustration, and the specific embodiments disclosed are not intended to limit the invention to the particular forms disclosed. The particular implementation of the supportive device that supports and elevates the buttocks above a seating surface may vary depending upon the particular context or application. By way of example, and not limitation, the supportive device that supports and elevates the buttocks above a seating surface described in the foregoing were principally directed to a supportive device having an inclined seat portion that elevates the buttocks above the thighs, and detachably attached back portion that supports the back implementations; however, similar techniques may instead be applied to a back portion for recent back surgery patients that elevates sections of the back above a back rest, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A device for enabling a patient to sit on a chair without putting any pressure on the buttocks area after a Buttock Augmentation Surgery or any other surgery affecting the lower rear area of a human trunk comprising:

a seat portion configured to support the buttocks area and thigh area, to elevate the buttocks area in order for the buttocks area to not touch a surface of a seating section of a chair implement where said seat portion is employed, said seat portion is further configured to alleviate a pressure on the buttocks area caused by a full weight of the patient while in a sitting position, said seat portion being bifurcated into at least two regions, said at least two regions comprising:

an upper region comprising a gradient constituent configured to provide a horizontally sloping seat portion that slopes downward toward a front of the seat portion, said upper region configured to provide a seating surface area that supports the thigh area and buttocks area, said upper region comprises at least a pair of depression parts configured to conform to a general shape of the buttocks area and the thigh area, said pair of depression parts being further configured to cradle the buttocks and the thighs while in said sitting position, said pair of depression parts being further configured to disperse a full weight of the patient on a wider seating surface area of said seat portion to alleviate pressure on the buttocks area caused by the full weight of the patient;

a lower region, said lower region comprises a bottom part configured to engage the surface of said seating section of said chair implement where the seat portion is employed, said lower region comprises a gradient constituent configured to provide a horizontally sloping seat portion that slopes downward toward the front of the seat portion, said gradient constituent is configured to avert the full weight of the patient being exerted on the buttocks area to the thigh area, while in said sitting position;

wherein the seat portion comprises a front face that is generally planar and a rear face that is generally planar, and wherein the depression parts each comprise a partial round cylindrical surface that is continuous from the rear face to the front face of the seat portion; and wherein a connection between the upper and lower regions is continuous from the rear face to the front face and defines a plane such that the upper and lower regions provide vertically adjacent layers of the seat portion.

2. The device of claim 1, in which said seat portion further comprising the front face being configured to face forward towards knees of the sitting patient.

3. The device of claim 2, in which said seat portion further comprising the rear face configured to face rearward towards the back section of the seating surface.

4. The device of claim 3, in which said front face comprising a height constituent approximately smaller than a height constituent of the rear face, wherein a height difference is configured to create said gradient constituent to approximately horizontally slope from the rear face down to the front face, said gradient constituent is configured to avert a full weight of the patient being exerted on the buttocks area to the thigh area, while on said sitting position.

5. The device of claim 4, wherein said upper region and lower region are joined together by adhesion means.

6. The device of claim 4, wherein said upper region and lower region are joined together by sewing or tapestry means.

7. The device of claim 5, in which said upper region and lower region comprises at least one of, an EVA Foam, a Memory foam, a Polyurethane Foam, a Closed Cell Foam, a Rebond Foam, a Recycled Foam, and a PU Foam.

8. The device of claim 6, in which said lower region comprises an inflatable material filled with air or liquid.

9. The device of claim 8, in which said inflatable material comprises at least one of, an Inflatable PVC, and an Inflatable Nylon.

10. The device of claim 7, further comprising an outer cover implement configured to receive said seat portion, said outer cover implement is further configured to correspond to a shape of the seat portion, said outer cover implement comprises a removable outer cover implement for washing, reusing, or replacement.

11. The device of claim 10, said outer cover implement further comprises a fastening means configured to secure the seat portion inside, said outer cover implement further comprises a registering aperture.

12. The device of claim 11, said outer cover implement further comprises a handle instrument configured to aid in a movement of the seat portion.

13. The device of claim 1, further comprising a back portion, said back portion is configured to detachably attach to the seat portion and relieve pressure on the buttocks area when the patient is in a sitting position.

14. The device of claim 13, in which said back portion comprises at least one seat fastening means configured to fasten the seat portion to the back portion.

15. The device of claim 14, in which said back portion further comprises at least one back fastening means configured to fasten the back portion to the chair implement.

16. The device of claim 15, in which said at least one seat fastening means and at least one back fastening means comprises at least one of, a hook and loop fastener, a button fastener, a magnet fastener, and an adhesive fastener.

17. An appliance being configured to enable a patient to sit on a chair without putting any pressure on the buttocks area after a Buttock Augmentation Surgery or any other surgery affecting the lower rear area of a human trunk comprising:

means for elevating a buttocks area of the patient while the patient is in a sitting position, in which the buttocks area is substantially prevented from touching a surface of a seating section of a chair implement where said elevating means is employed, said elevating means comprise:

means for supporting the buttocks area and thigh area of the patient, said means for supporting the buttocks area and thigh area comprises means for distributing a full weight of the patient being exerted on the buttocks area to relieve pressure;

means for engaging a surface of said seating section of said chair implement, said engaging means comprises means for averting the full weight of the patient being exerted on the buttocks area to the thigh area; and means for joining said supporting means and engaging means;

means for receiving said means for elevating, said receiving means comprises a removable, washable and reusable receiving means; and means for supporting a back of the patient while the patient is in said sitting position.

18. An appliance being configured to enable a patient to sit on a chair without putting any pressure on the buttocks area after a Buttock Augmentation Surgery or any other surgery affecting the lower rear area of a human trunk comprising:

a seat portion configured to support the buttocks area and thigh area, to elevate the buttocks area in order for the buttocks area to not touch a surface of a seating section of a chair implement where said seat portion is employed, said seat portion is further configured to alleviate a pressure on the buttocks area caused by a full weight of the patient while in a sitting position, said seat portion comprising:

an upper region comprising a gradient constituent configured to provide a horizontally sloping seat portion that slopes downward toward a front of the seat portion, said upper region configured to provide a seating surface area that supports the thigh area and buttocks area, said upper region comprises at least a pair of depression parts configured to conform to a general shape of the buttocks area and the thigh area, said pair of depression parts being further configured to cradle the buttocks and the thighs while in said sitting position, said pair of depression parts being further configured to disperse said full weight of the patient on a wider seating surface area of said seat portion, to alleviate said pressure on the buttocks area caused by the full weight of the patient;

a lower region, said lower region comprises a bottom part configured to engage the surface of said seating section of said chair implement where the seat portion is employed, said lower region comprises a gradient constituent configured to provide a horizontally sloping seat portion that slopes downward toward the front of the seat portion, said gradient constituent is configured to avert the full weight of the patient being exerted on the buttocks area to the thigh area, while in said sitting position; and said upper region and lower region comprises at least one of, an EVA Foam, a Memory foam, a Polyurethane Foam, a Closed Cell Foam, a Rebond Foam, a Recycled Foam, and a PU Foam; and a front face, said front face being configured to face forward towards knees of said sitting patient;

a rear face, said rear face configured to face rearward towards a back section of the seating surface; and said front face comprising a height constituent approximately smaller than a height constituent of the rear face, wherein the height difference is configured to create said gradient constituents to horizontally slope from the rear face down to the front face, said gradient constituents are configured to avert the full weight of the patient being exerted on the buttocks area to the thigh area, while in said sitting position;

wherein the seat portion comprises the front face and the rear face, wherein the front face and the rear face are each generally planar, and wherein the depression parts each comprise a partial round cylindrical surface that is continuous from the rear face to the front face of the seat portion; and wherein a connection between the upper and lower regions is continuous from the rear face to the front face and defines a plane such that the upper and lower regions provide vertically adjacent layers of the seat portion.

19. The appliance of claim 18, further comprising an outer cover implement configured to receive said seat portion, said outer cover implement is further configured to correspond to a shape of the seat portion, said outer cover implement comprises:

a removable outer cover implement for washing, reusing, or replacement;

and a handle instrument configured to aid in a movement of the seat portion.

20. The appliance of claim 19, further comprising a back portion, said back portion is configured to detachably attach to the seat portion and relieve pressure on the buttocks area when the patient is in a sitting position, said back portion comprises at least one seat fastening means configured to fasten the seat portion to the back portion, and at least one back fastening means configured to fasten the back portion to the chair implement.

* * * * *